United States Patent [19]

Moody et al.

[11] Patent Number: 5,004,875

[45] Date of Patent: Apr. 2, 1991

[54] STORED ENERGY CONTACT OPERATING MECHANISM

[75] Inventors: G. Lawrence Moody; David A. Leone, both of Lawrenceville; Mark E. Bell, Atlanta, all of Ga.

[73] Assignee: Siemens Energy & Automation, Inc., Alpharetta, Ga.

[21] Appl. No.: 255,894

[22] Filed: Oct. 11, 1988

[51] Int. Cl.[5] ..... H01H 5/00

[52] U.S. Cl. ..... 200/400; 335/171; 200/401; 200/419; 200/424; 200/425

[58] Field of Search ..... 200/400, 401, 410, 411, 200/415, 419, 421, 424, 425, 430; 335/171

[56] References Cited

U.S. PATENT DOCUMENTS

| | | | |
|---|---|---|---|
| 3,365,561 | 1/1968 | Jencks et al. | 200/166 |
| 3,689,720 | 9/1972 | Patel | 200/400 |
| 3,735,075 | 5/1973 | Kidd | 200/146 |
| 3,832,504 | 8/1974 | Cellerini et al. | 200/400 |
| 4,095,676 | 6/1978 | Howe et al. | 200/400 |
| 4,166,205 | 8/1979 | Maier et al. | 200/153 |
| 4,219,713 | 8/1980 | Maier et al. | 200/153 |
| 4,251,702 | 2/1981 | Castonguay et al. | 200/153 |
| 4,291,209 | 9/1981 | Seidling et al. | 200/153 |
| 4,336,516 | 6/1982 | Bratkowski et al. | 335/171 |
| 4,404,446 | 9/1983 | Maier et al. | 200/320 |
| 4,524,339 | 6/1985 | Chabot | 335/22 |
| 4,580,021 | 4/1986 | Fujikake | 200/153 |
| 4,742,200 | 5/1988 | Marquardt et al. | 200/325 |
| 4,750,375 | 6/1988 | Godesa | 74/2 |

*Primary Examiner*—Henry J. Recla
*Assistant Examiner*—Glenn T. Barrett
*Attorney, Agent, or Firm*—Peter A. Luccarelli, Jr.; James G. Morrow

[57] ABSTRACT

A mechanism for accumulating and storing mechanical energy, wherein the energy is used to close the primary contacts of a circuit breaker. The energy can be input to the mechanism manually or by means of a motor. The mechanism includes a series of linkages which function to utilize the energy to close the primary contacts. These linkages also function to maintain the closing force upon the primary contacts, while also functioning to allow rapid contact opening when desired.

12 Claims, 12 Drawing Sheets

STORED ENERGY CONTACT OPERATING MECHANISM

CROSS-REFERENCE TO RELATED APPLICATIONS

This patent application is related to the patent application entitled STORED ENERGY OPERATING MECHANISM CHARGING HANDLE AND COVER ASSEMBLY assigned to the same assignee as the present invention and filed concurrently herewith.

BACKGROUND OF INVENTION

This invention relates to a circuit breaker, and more particularly, to a stored energy mechanism for opening and closing the primary contacts of a circuit breaker.

Stored energy mechanisms for use in circuit breakers having single or multiple poles are known. For example, U.S. Pat. No. 4,291,209 relates to a circuit breaker having a movable contact-drive mechanism connection. One problem encountered in producing a stored energy mechanism is providing a mechanism which can be charged or energized when the primary contacts are either open or closed. Another problem is providing the mechanism with a linkage assembly which uses the stored energy of the mechanism efficiently to close the primary contacts, while also providing a linkage assembly which permits the contacts to be opened rapidly.

SUMMARY OF THE INVENTION

An object of tee present invention is to provide a mechanism to accumulate and store energy used to close the primary contacts of a circuit breaker. Another object of the present invention is to provide a mechanism which utilizes the stored energy to close the primary contacts of a circuit breaker. Another object of the present invention is to provide a mechanism for opening the primary contacts of a circuit breaker.

Accordingly, there is provided a circuit breaker comprising a support structure including a mounting means, a first contact and a second contact for carrying current, means for storing energy, means for controlling rotation of a rotatable member, and means for opening and closing the contacts. The means for storing energy includes a rotatable member being rotatable about a first shaft supported by the support structure, and at least one energy storing means including a first coupling location and a second coupling location. The first coupling location is coupled to the rotatable member, the second coupling location is coupled to the mounting means, and the rotatable member is adapted to rotate such that the energy storing means can be deformed to store energy. The contacts are adapted to be opened and closed and the means for opening and closing the contacts is coupled to the rotatable member such that energy stored in the energy storing means can be utilized to close the contacts.

An advantage of the present invention is that closing energy can be accumulated and stored regardless of whether or not the primary contacts are opened or closed. Another advantage of the present invention is that mechanism for opening the primary contacts is configured to allow rapid opening of the primary contacts. Another advantage of the present invention is that the opening, closing, and energy storage functions are incorporated into a single unit assembly.

Various other objects and advantages of the present invention will become apparent from the following description, with reference to the accompanying drawing.

DETAILED DESCRIPTION OF THE PREFERRED EMBODIMENT

Figure 1:
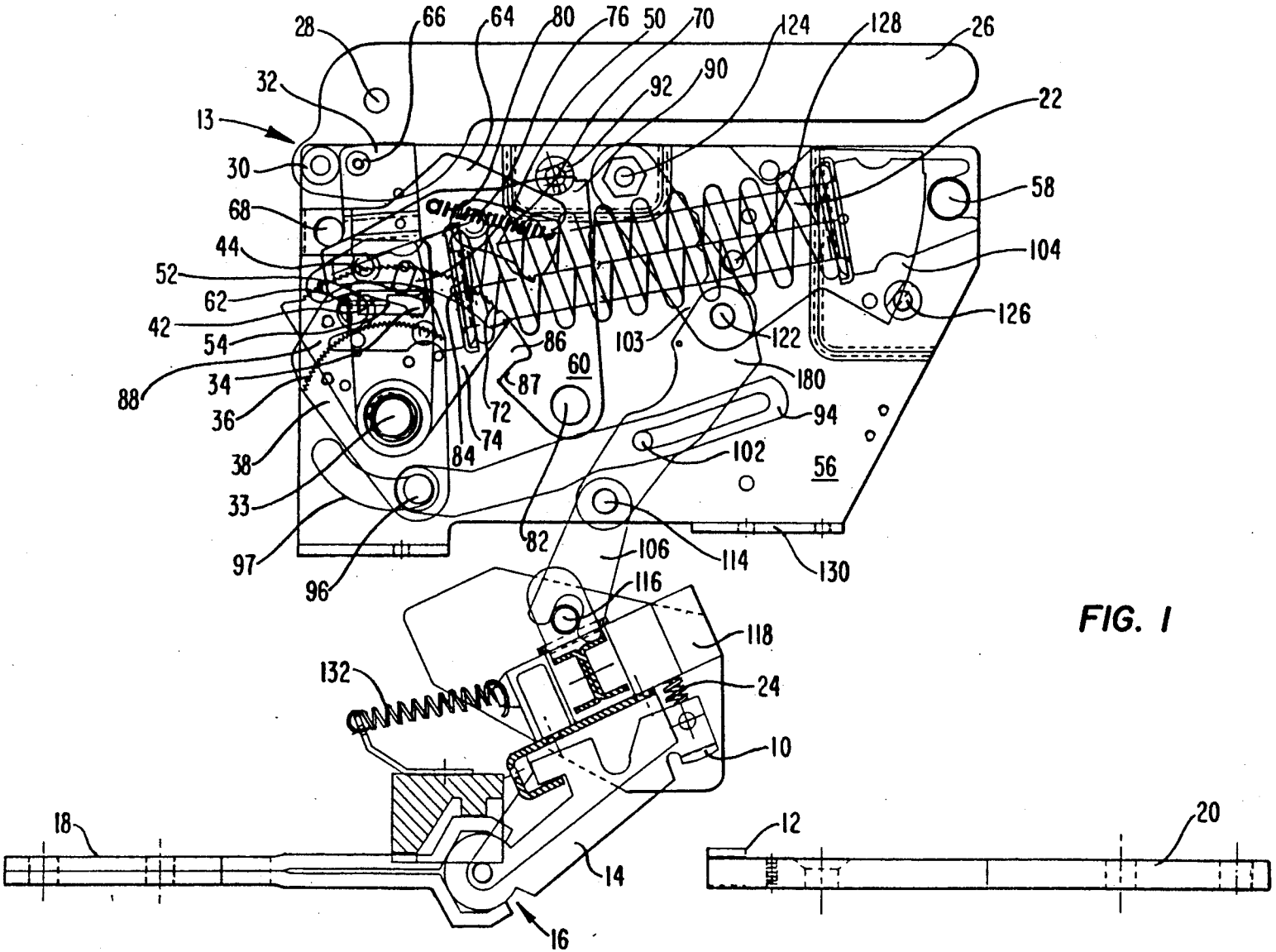
FIG. 1 is a side view of a circuit breaker wherein the primary contacts are open and the charging springs of the stored energy mechanism are not charged.

Referring now to FIG. 1–4,, these figures illustrate four operating configurations for respective primary contacts 10, 12 and a stored energy mechanism 13. The stored energy mechanism 13 acts upon respective pivoting contact carrying arms 14 which cooperate with a pivot joint 16 such that the contacts 10, 12 can be opened and closed to control the flow of current between the terminals 18, 20 of the circuit breaker.

The stored energy mechanism 13 suitably comprises two charging springs 22, a charging handle 26, two charging arms 32, two charging blocks 38, a ratchet assembly, and a latch link 60. The mechanism 13 is operatively coupled to contact carrying arms 14 by the push links 94, latch links 104, top tripping links 100, lower links 106, and cross bar 118.

FIG. 1 illustrates the circuit breaker wherein the primary contacts 10, 12 are open and the charging springs 22 of the stored energy mechanism are not charged. To close the contacts 10, 12, the springs 22 are charged (compressed) such that they have enough energy to close the contacts 10, 12. Closing the contacts 10, 12 requires the compression of a spring 24 for each pair of contacts 10, 12 and the extension of at least one spring 132 for each pole. (In the preferred embodiment of the invention, each pole of the circuit breaker has a plurality of contact 10, 12 pairs and contact carrying arms 14. Accordingly, for a three pole circuit breaker, the s 22 would be required to supply enough energy to compress all springs 24 and extend all springs 132.)

CHARGING SEQUENCE FOR THE CHARGING SPRINGS

In general, the energy for charging the springs 22 is input to the springs 22 by way of a charging handle 26 which is pivotable about a shaft 28 mounted in the circuit breaker cover (not shown). The charging handle 26 is adapted to cooperate with two charging arms 32 and ratchet assembly for rotating two charging blocks 38. When the charging blocks 38 are rotated, the springs 22 are compressed and latched into their compressed position. A latch link 60 is used to latch the springs 22 in their compressed position.

The handle 26 includes pivotally mounted bushings 30 which interact with the charging arms 32 of the stored energy mechanism. Pivoting the handle 26 counter-clockwise from its stored position about the shaft 28 causes the bushings 30 to come into contact with the charging arms 32 such that the charging arms 32 rotate clockwise on a first shaft such as a shaft 33. The shaft 33 is rotatably mounted with bearings 35 between the mechanism side plates 56.

Figure 9A:
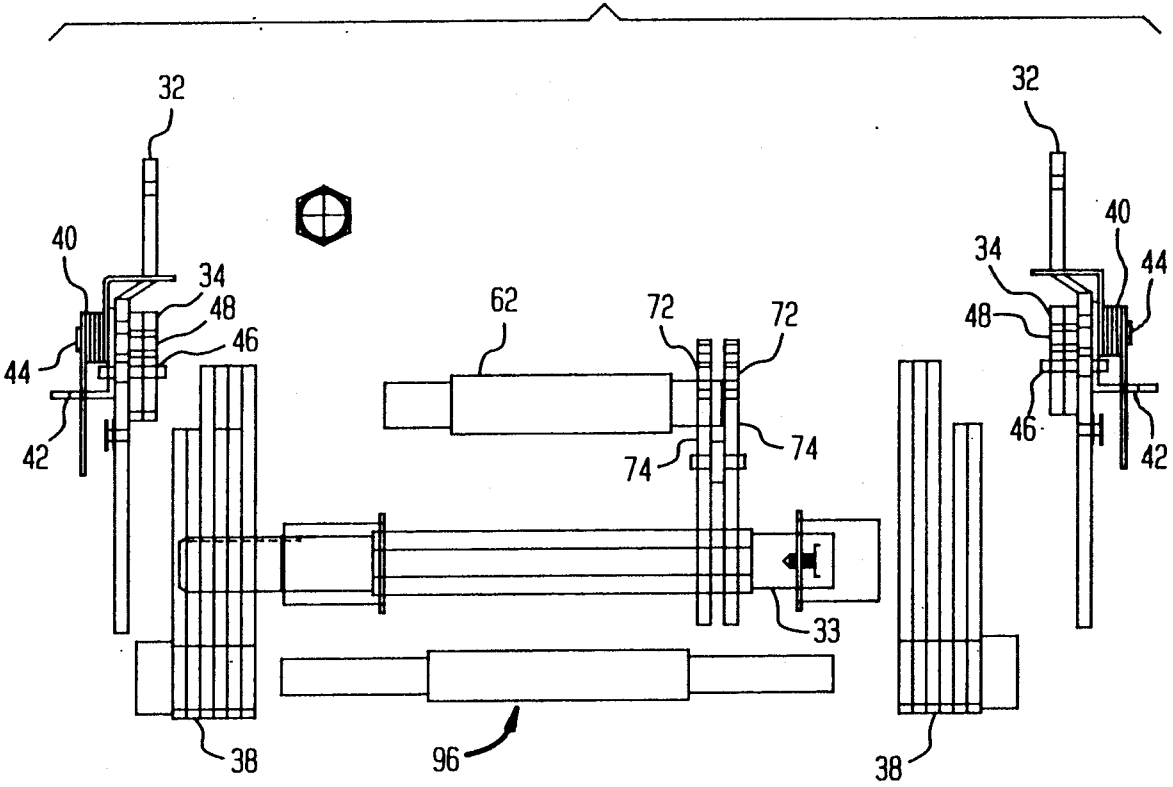
FIG. 9*a* is an exploded end view of the ratcheting assembly as viewed along line B—B of FIG. 9.
Figure 9:
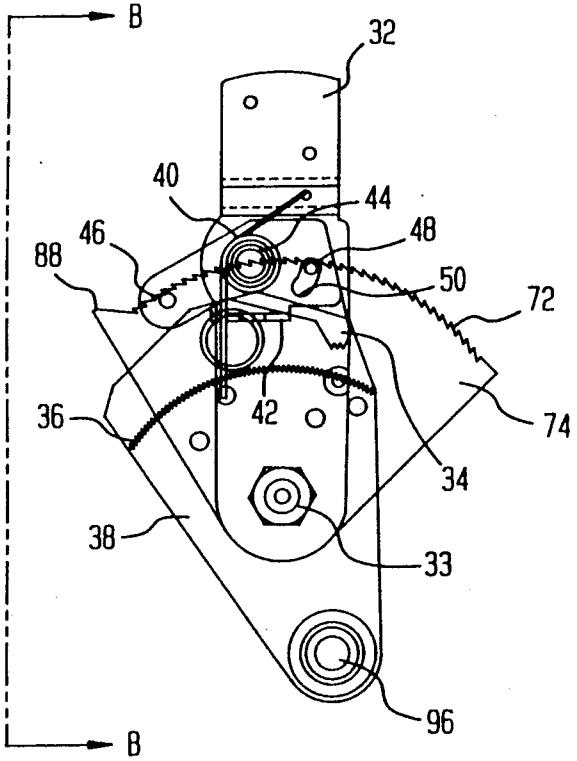
FIG. 9 is a side view of the ratcheting assembly.
Figure 10A:
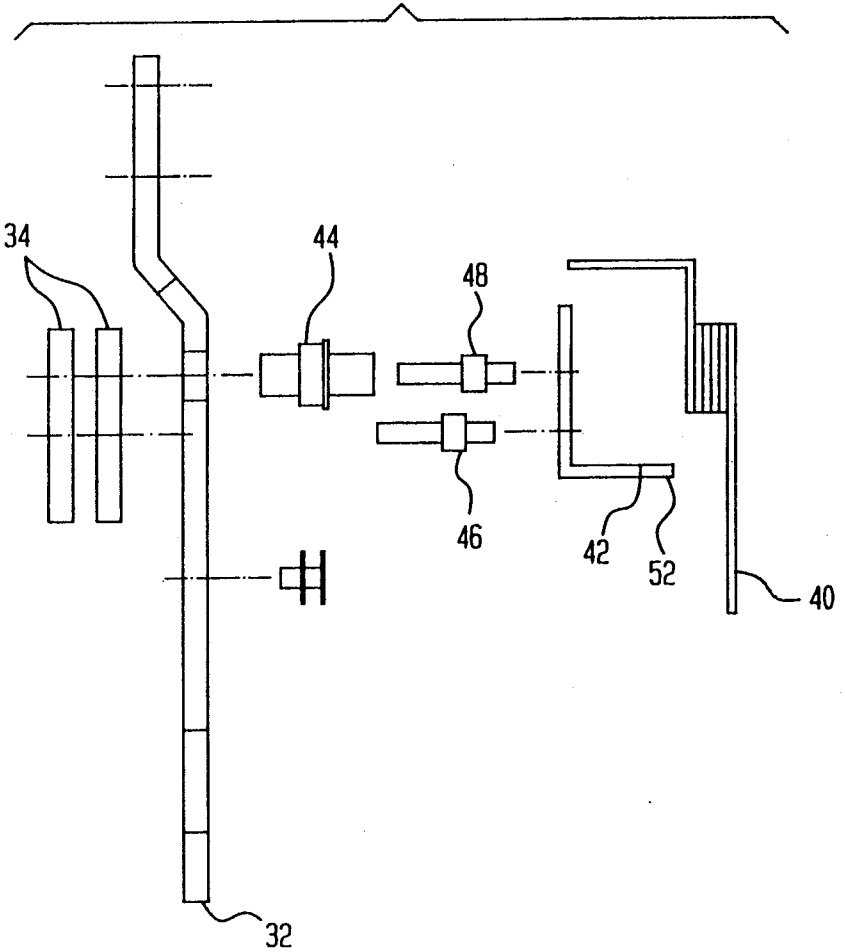
FIG. 10*a* is an exploded end view of the charging arm assembly as viewed along line C—C of FIG. 10.
Figure 10:
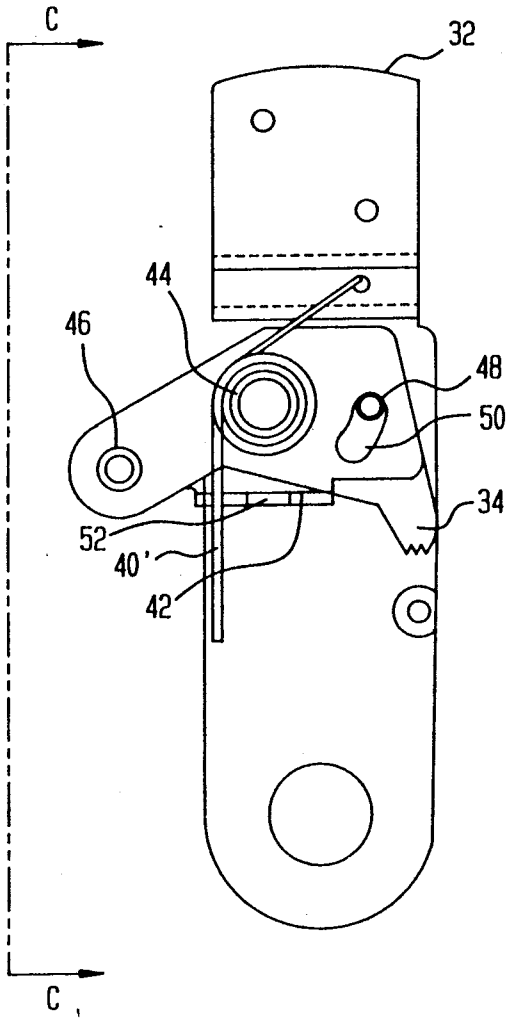
FIG. 10 is a side view of the charging arm assembly.

When the charging arms 32 are rotated clockwise, torsion springs 40 (best seen in FIGS. 9–10*a*) urge pawl control members 42 to rotate the charging pawls 34 clockwise. As the pawls 34 are rotated clockwise, the pawls 34 engage the teeth 36 of charging blocks 38. FIGS. 9 to 10*a* illustrate the mechanism for engaging the pawls 34 with the blocks 38. A pivot pin 44 pivotally mounts the pawls 34 and members 42 on opposite sides of the charging arms 32. The pawls 34 and members 42 are spaced apart and riveted together with rivets 46, 48 such that they are free to pivot with respect to the charging arms 32. The rivets 48 also serve to limit the pivot angle of the pawls 44 and members 42 by interacting with slots 50 in the charging arms 32.

The pawl control members 42 include extensions 52 which cooperate with openings 54 in the mechanism side plates 56 to disengage the charging pawls 34 from the charging blocks 38. This occurs when handle 26 is returned to its stored position as shows in FIGS. 1–4. When the charging arms 32 are rotated as far counter-clockwise as they are permitted, the extensions 52 and openings 54 cooperate to bias the members 42 and the pawls 34 against the force of the torsion spring 40 such that the pawls 34 will not engage the charging blocks 38. When the charging arms 32 are rotated clockwise, the contact between the extensions 52 and openings 54 ceases and the torsion spring 40 urges the pawls 34 into engagement with the charging blocks 38.

When the charging pawls 34 are engaged with the charging blocks 38, and the charging arms 32 are rotated clockwise, the charging blocks 38 are also rotated clockwise on the shaft 33. As the charging blocks 38 are rotated clockwise, the charging springs 22 are compressed between a spring stop member 58 and a second shaft such as a spring carrier shaft 62. Clockwise rotation of the charging arms 32 also causes a member 66, which connects the charging arms 32, to contact a control lever 64 such that the lever 64 pivots clockwise about its pivot 68. Upon pivoting, the control lever 64 urges a pair of holding pawls 70 into engagement with the teeth 72 of holding gears 74.

Figure 12A:
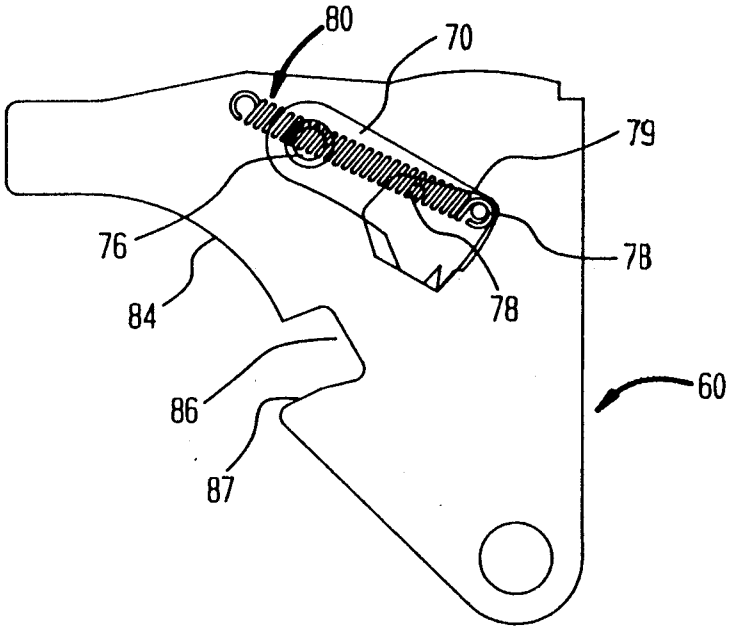
FIG. 12*a* is a side view of the spring latch assembly.
Figure 12:
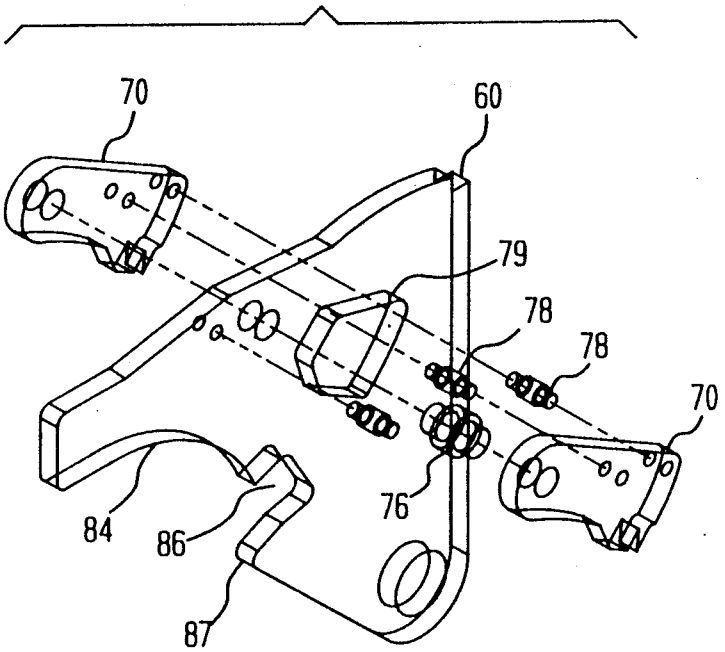
FIG. 12 is a exploded perspective view of the spring latch assembly.

The holding pawls 70 are rotatably mounted with a pivot 76 on opposite sides of the latch link 60 and fixed together with a pair of rivets 78. The rivets 78 cooperate with the top surface of an opening 79 in the latch link 60 such that a tension spring 80 can bias the holding pawls 70 away from the holding gears 74. When the control lever 64 urges the holding pawls 70 into engagement with the holding gears 74, the central axis of the spring 80 moves over the center of the pivot 76 such that the spring 80 biases the holding pawls toward the holding gears 74. (See FIGS. 12 and 12*a*.)

The holding gears 74 are fixed to the shaft 33 such that the holding pawls 70 and the holding gears 74 cooperate to prevent the charging blocks 38 from rotating counter-clockwise when the charging arms 32 are rotated counter-clockwise and the charging pawls 34 are disengaged from the teeth 36 of the charging block 38. This cooperation allows the springs 22 to be compressed by pumping the handle 26 more than once, thus requiring less force to move the handle 26 during the compression process.

As previously mentioned, the latch link 60 is used to latch the springs 22 in their compressed position. The latch link 60 is pivotally supported by a third shaft such as a latch shaft 82 which extends between the mechanism side plates 56. The latch link 60 includes a curved surface 84 which restS upon the spring carrier shaft 62 while the springs 22 are being compressed. The pivot 68 for the control lever 64 prevents the curved surface 84 from pivoting too far away from the spring carrier shaft 62.

Figure 4:
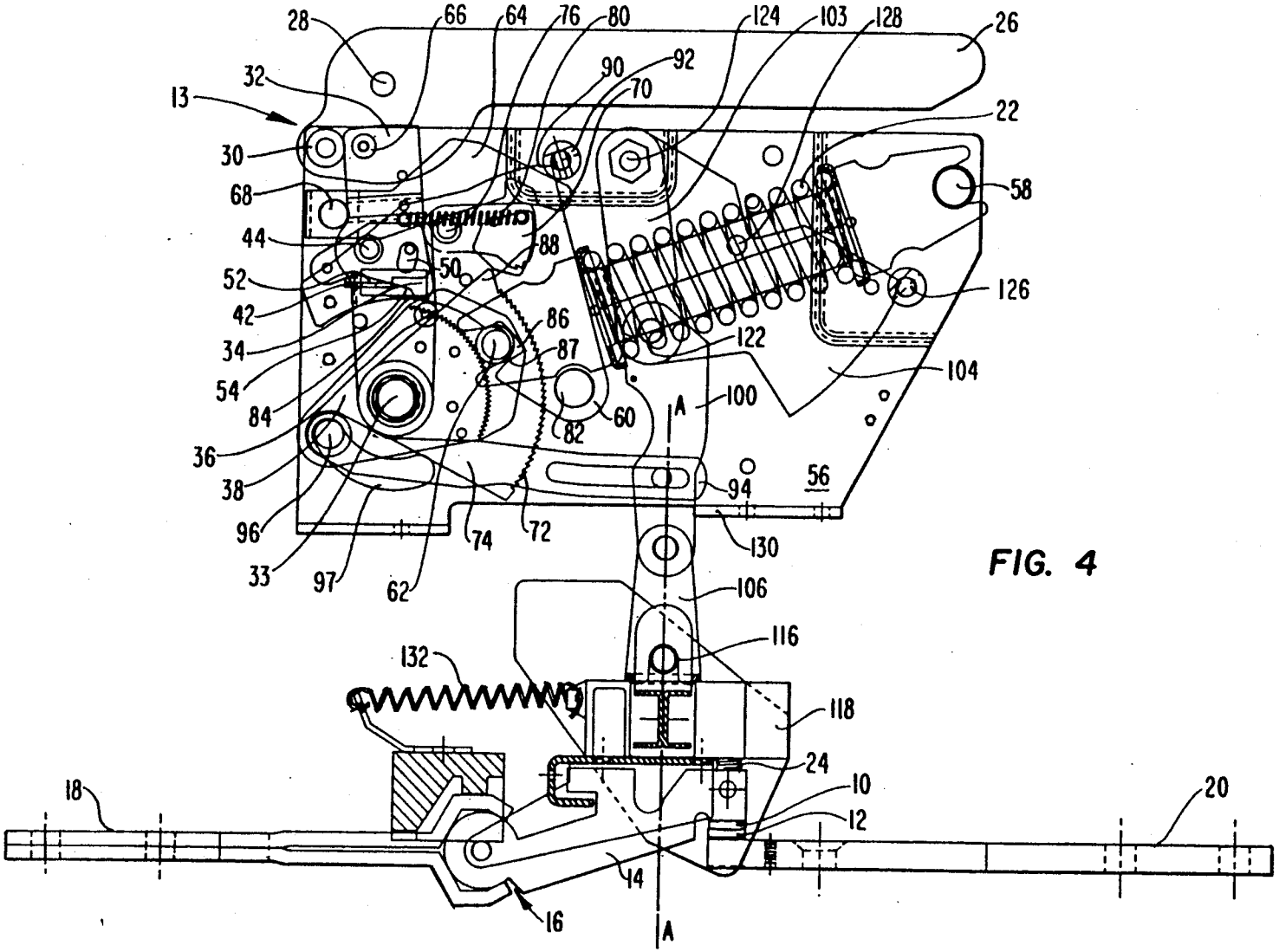
FIG. 4 is a side view of a circuit breaker wherein the primary contacts are closed and the charging springs of the stored energy mechanism are charged.
Figure 5:
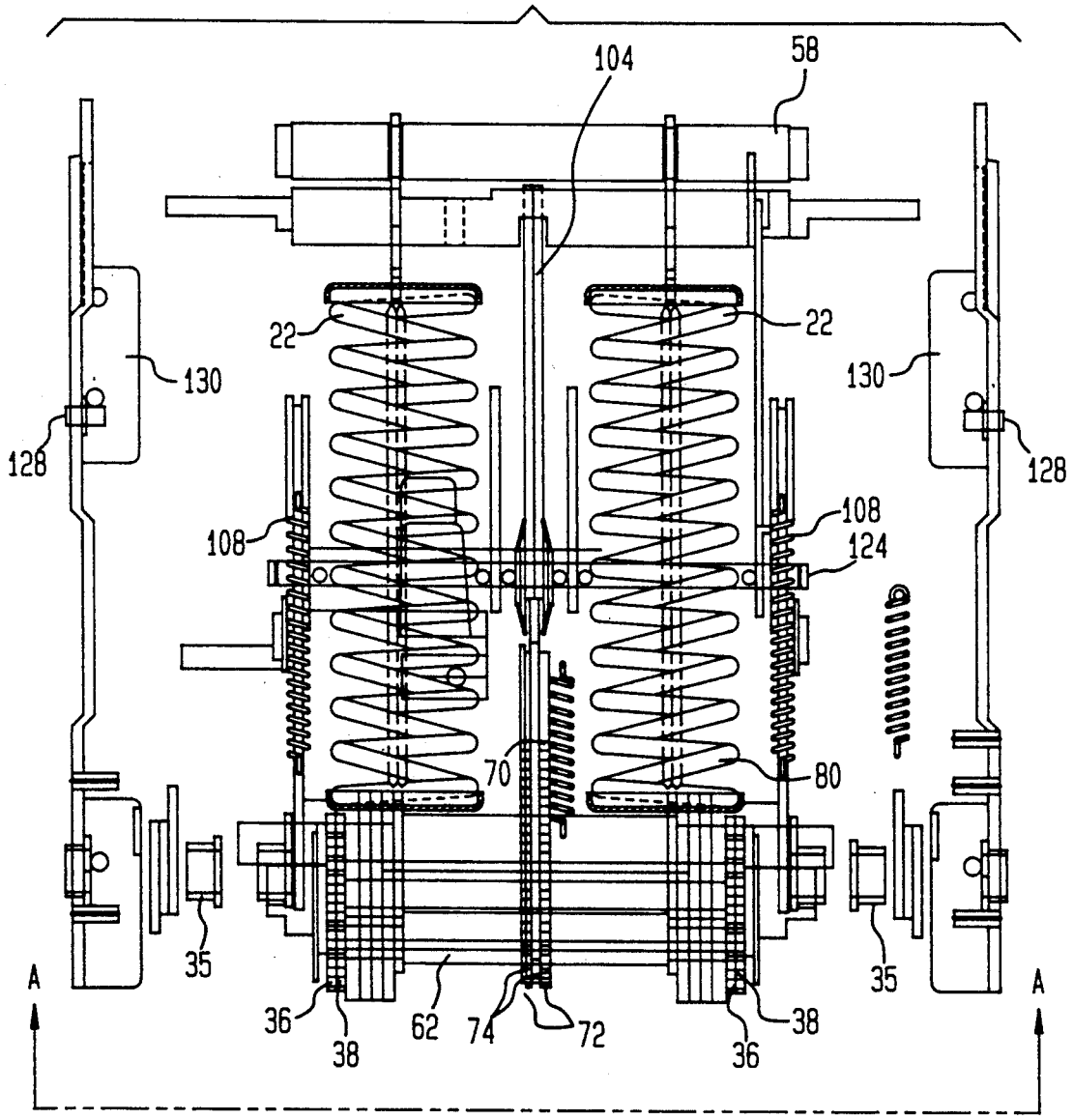
FIG. 5 is a exploded top view of the stored energy mechanism.
Figure 6:
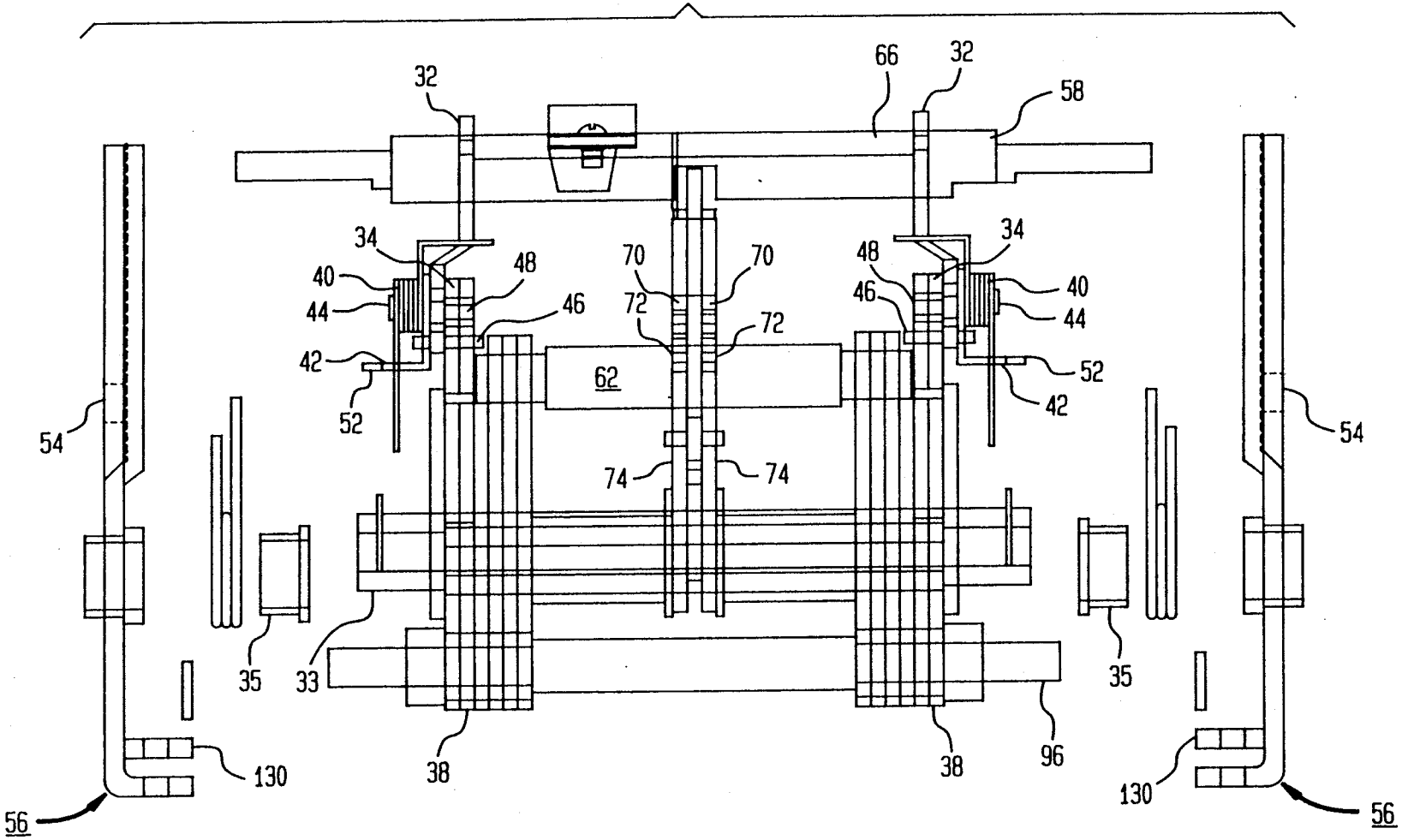
FIG. 6 is an exploded end view of the stored energ mechanism as viewed along line A—A in FIG. 5.
Figure 7A:
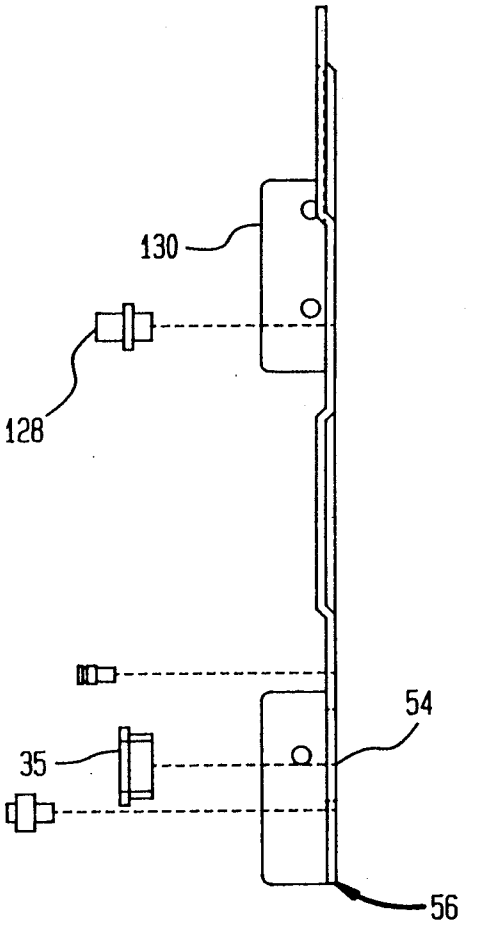
FIG. 7*a* is a top view of the right mechanism support plate.
Figure 7:
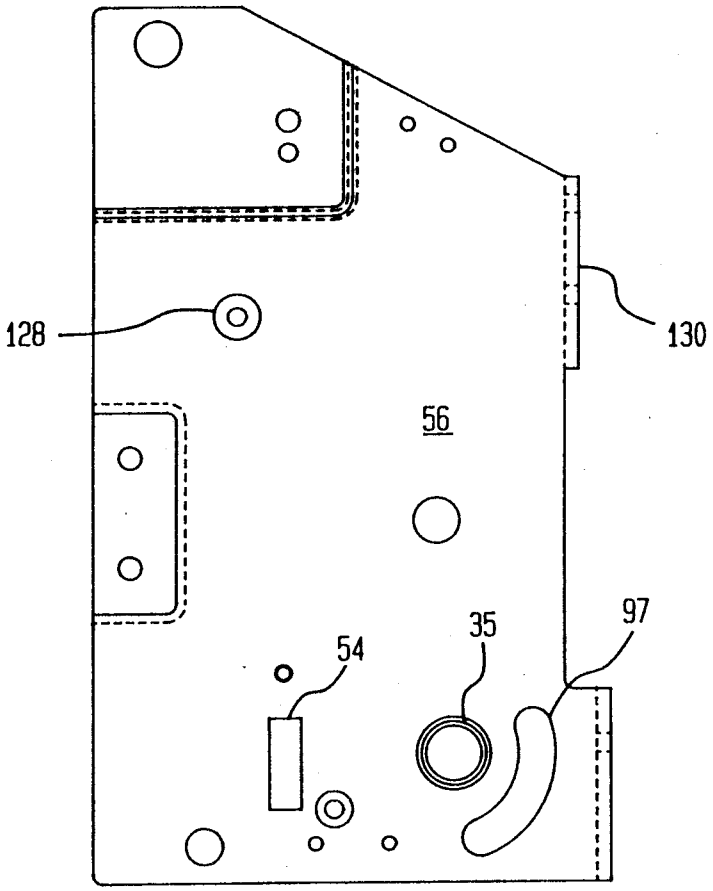
FIG. 7 is a side view of the right mechanism support plate.
Figure 8A:
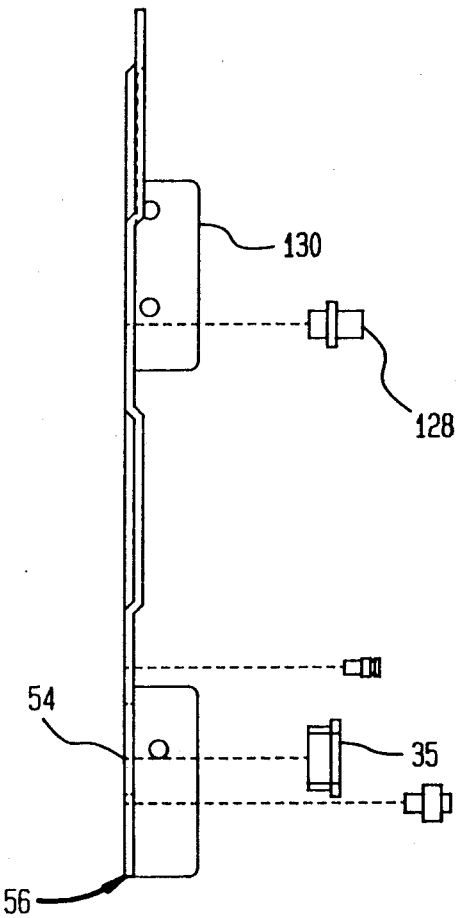
FIG. 8*a* is a top view of the left mechanism support plate.
Figure 8:
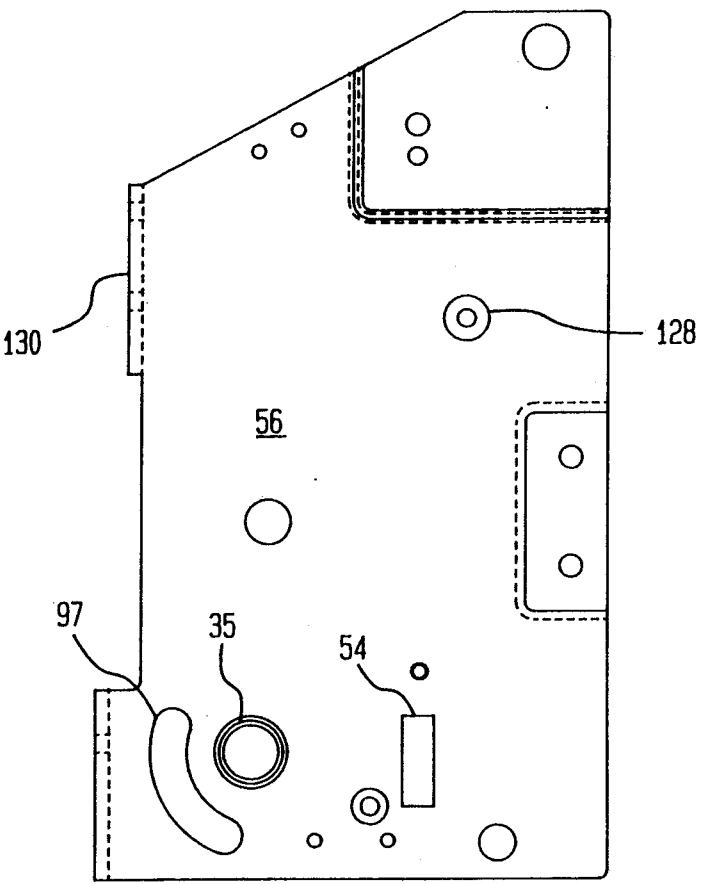
FIG. 8 is a side view of the left mechanism support plate.

When the springs 22 are compressed to a predetermined length, the shaft 62 reaches the end of the curved surface 84 and forces against the side 87 of the latch opening 86 such that the latch link 60 pivots counter-clockwise to fully engage the shaft 62. Additionally, when the shaft 62 reaches the latch opening 86, an extension 88 on the holding gears 74 forces the holding pawls 70 to rotate counter-clockwise about the pivot 76 such that the tension spring 80 biases the holding pawls 70 away from the holding gear 74. Before the holding pawls 70 are disengaged from the holding gear, the latch surface 90 of the latch link 60 engages a stop latch 92 to prevent the latch link 60 from rotating clockwise. (FIGS. 2 and 4 illustrate the latched configuration.)

In addition to compressing the charging spring 22, the charging blocks 38 also control the movement of push links 94. At the first ends of the push links 94, the push links 94 are pivotally connected to a fourth shaft such as a shaft 96 which follows curved openings 97 in the mechanism side plates and extends between the charging blocks 38. The second ends of the push links 94 include slots 98 for connecting the push links 94 to the top tripping links 100. The push links 94 are connected to the top tripping links 100 with bushings 102 which pass through the slots 98 and the links 100.

CONTACT CLOSING SEQUENCE

Figure 2:
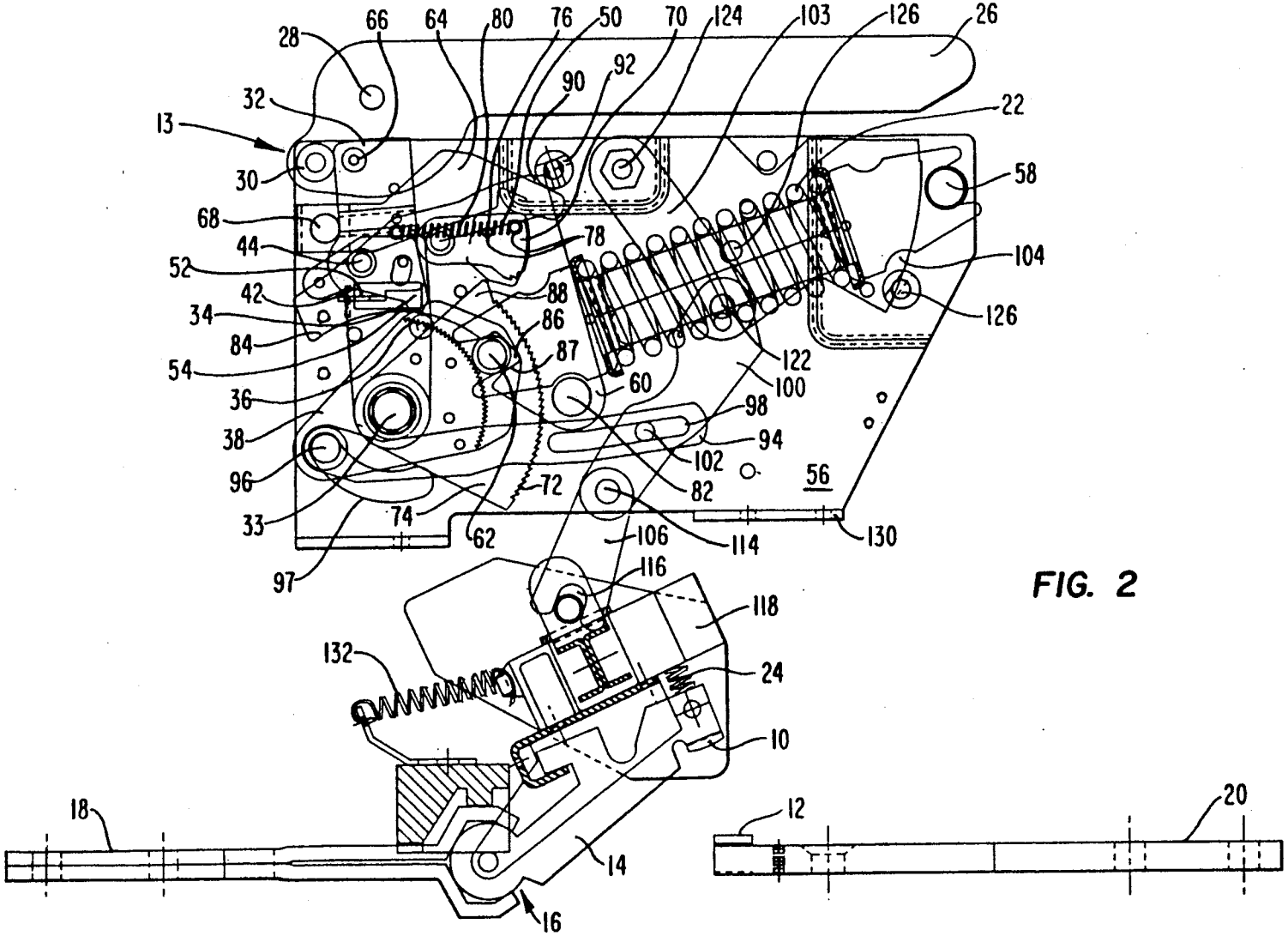
FIG. 2 is a side view of a circuit breaker wherein the primary contacts are open and the charging springs of the stored energy mechanism are charged.

FIG. 2 illustrates the circuit breaker wherein the primary contacts 10, 12 are open and the charging springs 22 are latched into their charged position. To open and close the primary contacts 10, 12, two contact operating linkage assemblies are provided. In general, the contact operating linkage assemblies include top tripping links 100, side links 103, latch link 104, lower links 106, trip shaft 124, and a biasing spring 108. (It should be noted that FIG. 2 illustrates a configuration for the contact operating linkage assemblies which is not stable.)

Figure 11A:
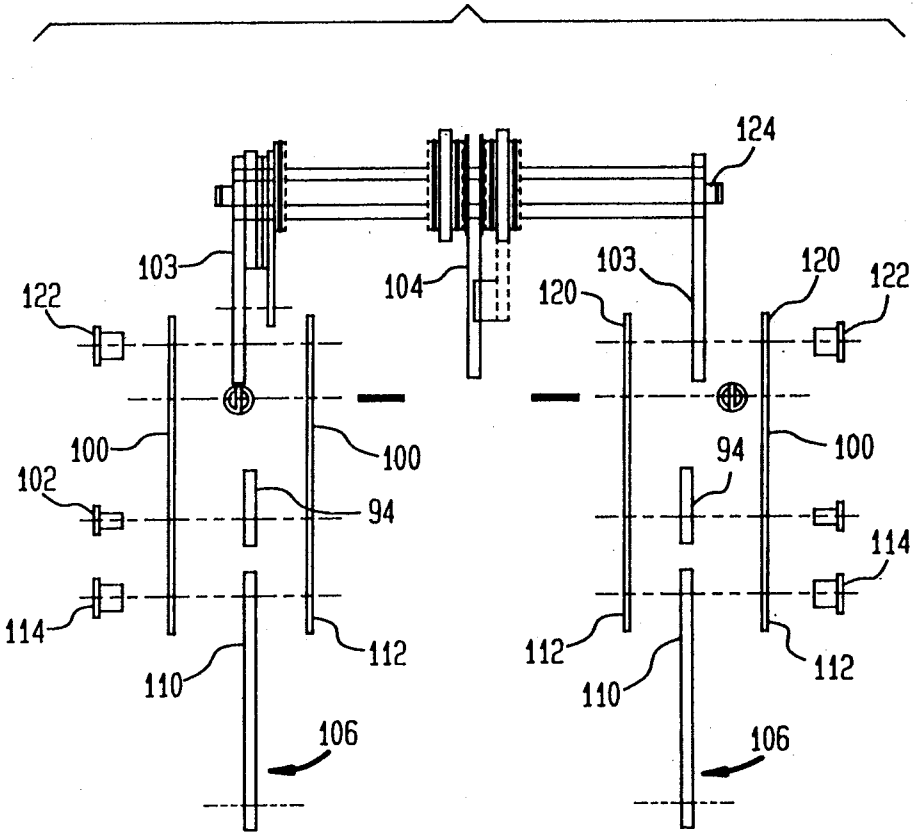
FIG. 11*a* is an end view of the contact operating assembly as viewed along line D—D of FIG. 11.
Figure 11:
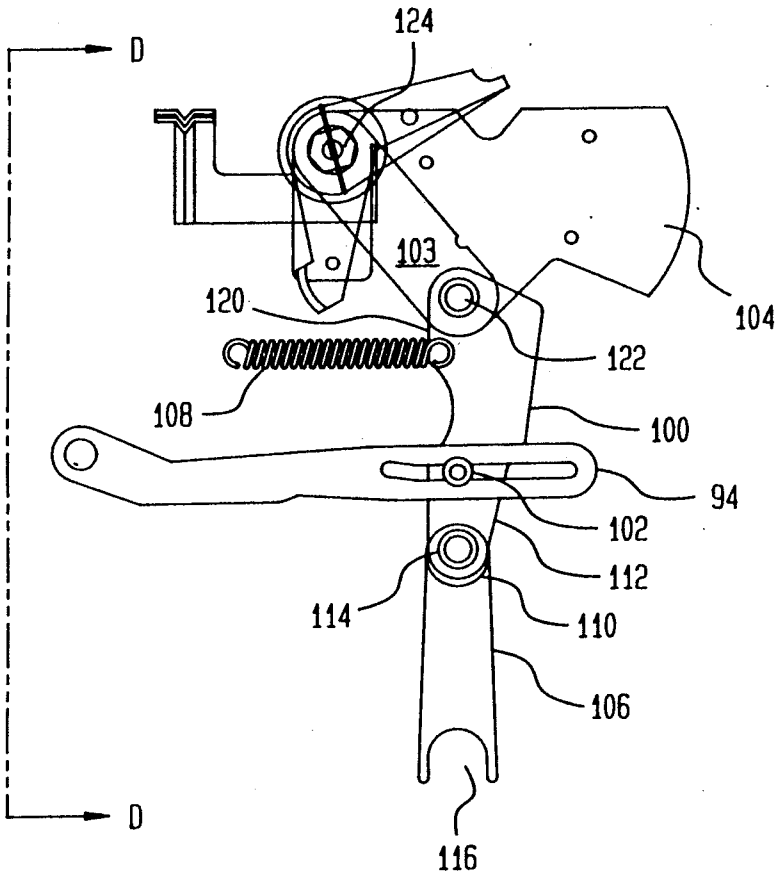
FIG. 11 is a side view of the contact operating assembly.

FIGS. 11 and 11*a* illustrate the relationship between the components of the operating linkage assemblies. The top ends 110 of the lower links 106 are attached with pivot bushings 114 to the bottom ends 112 of the top tripping links 100. The lower link 106 includes a saddle 116 for straddling the circuit breaker crossbar 118. The top ends 120 of the top tripping links 100 are attached to the side links 103 with pivot bushings 122. The latch link 104 is centrally mounted on a shaft 124 extending between the mechanism side plates 56. One side link 103 is mounted on each end of shaft 124. Stops 128 are provided to prevent the side links 103 from rotating too far counter-clockwise during the opening sequence.

Figure 3:
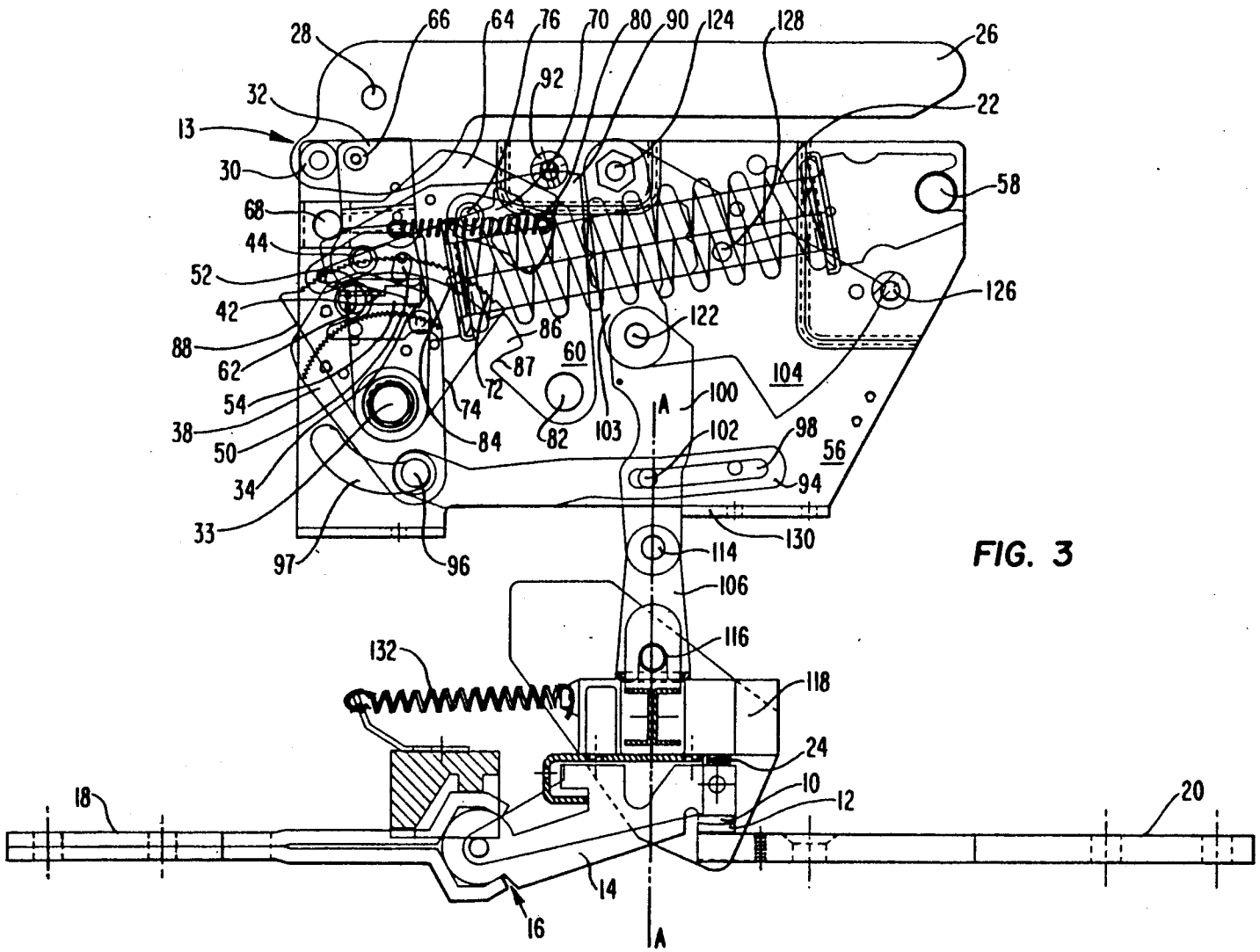
FIG. 3 is a side view of a circuit breaker wherein the primary contacts are closed and the charging springs of the stored energy mechanism are not charged.

To transform the unstable configuration of FIG. 2 into a stable configuration, the latch link 104 is rotated clockwise to engage stop latch 126 as shown in FIGS. 3 and 4. This is accomplished by tension springs 108. When the latch link 104 is rotated to engage the stop latch 126, the top tripping links 100 rotate counter-clockwise about the pivot bushings 122 and the lower links 106 rotate counter-clockwise about the pivot bushings 114. The side links 103 and tripping shaft 124 rotate clockwise with the latch link 104. Additionally, the bushings 102 are slid to the left-most end of the slots 98 in the push links 94. In this configuration, the contact operating assemblies are ready to accept the stored energy from the springs 22 to close the primary contacts 10, 12.

To deliver the energy stored in the springs 22 to the contact operating assemblies, the stop latch 92 is operated to disengage the latch link 60 from the spring carrier 62. Upon disengagement, the latch link 60 rotates clockwise about the latch shaft 82 such that the spring carrier 62 is released from the latch opening 86. Upon release of the spring carrier 62, the springs 22 are allowed to drive the charging blocks 38 counter-clockwise about the shaft 33 such that the push links 94 are driven to the right. When the push links are driven to the right, the left-most ends of the slots 98 drive the bushings 102 to the right. This causes the top tripping links 100 to rotate counter-clockwise about the pivot bushing 122 into contact with mechanism pads 130, while the lower links 106 rotate clockwise about the pivot bushings 114.

The configuration of the contact operating assemblies after the primary contacts 10, 12 have been closed is illustrated in FIGS. 3 and 4. In this configuration, the centers of the pivot bushings 122 are offset from the line A—A which runs through the centers of the saddles 116 and pivot bushings 114. By arranging the links 103, 100, 106 with this geometry, the link 100 is forced against the mechanism pads 130 via a component of the upward force exerted by the opening springs 132 and the springs 24. This geometrical relationship allows the links 100, 106 to toggle into a stable position for holding the primary contacts 10, 12 closed.

CONTACT OPENING SEQUENCE

Both FIGS. 3 and 4 illustrate the circuit breaker wherein the primary contacts 10, 12 are closed to complete the current path between the terminals 18, 20. In most situations, when the primary contacts 10, 12 are required to open, it is important that the contacts open as rapidly as possible. To enhance the speed with which the contacts open, it is advantageous to provide a contact operating mechanism which requires as few reduction stages as possible, while also providing a linkage arrangement which requires reduced energy to move such that the contacts open rapidly.

To open the primary contacts 10, 12, the stop latch 126 is operated such that the latch link 104, and the side links 103 rotate counter-clockwise about the shaft 124 causing the center of the pivot bushings 122 to pass over the center of line A—A. This action permits the links 100, 106 to freely pivot with respect to each other and to begin to move upward instantaneously. This allows the opening springs 132 to pull the primary contacts 10, 12 apart with very little resistance from the links 100, 106. The push links 94 offer very little resistance to the pivoting of the links 100, 106 since the bushings 102 are designed to slide freely within the slots 98.

As previously mentioned, energy can be accumulated and stored in the springs 22 when the primary contacts are either opened or closed. This is accomplished by using push links 94 which include a slot 98 which allows the link 100 to move freely at all times except while the contacts 10, 12 are being closed.

While one embodiment of a stored energy contact operating mechanism has been shown and described in detail herein, various other changes and modifications may be made without departing from the scope of the present invention.

We claim:

1. A circuit breaker that permits selective compression of a spring, comprising:

a support structure;

a first contact and a second contact for carrying current, the contacts being adapted to be opened and closed;

means for storing energy including:

a rotatable member being rotatable in a first direction about and supported by a first shaft supported by the support structure;

a second shaft supported by the rotatable member such that the second shaft is substantially parallel to the first shaft and offset from the first shaft;

a third shaft supported by the support structure such that the third shaft is substantially parallel to the first shaft and offset from the first shaft;

a fourth shaft supported by the rotatable member such that the fourth shaft is substantially parallel to the first shaft and offset from the first shaft;

a latch member rotatable about the third shaft, the latch member defining a first surface for resting upon the second shaft, the first surface defining a latch opening for engaging the second shaft;

the spring being coupled to the support structure and the second shaft, such that the spring is compressed to store energy when the rotatable member is rotated in the first direction, and the second shaft is engaged by the latch opening in response to the spring being compressed a predetermined distance;

a first stop latch which restricts the latch members from rotating such that the latch opening maintains engagement with the second shaft;

means for rotating the rotatable member in the first direction; and means for opening and closing the contacts, wherein the means is coupled to the fourth shaft such that energy stored in the compressed spring can be utilized to close the contacts.

2. The circuit breaker of claim 1, wherein the means for rotating includes a ratchet assembly engagable with the rotatable member such that the spring is disposed to be selectively compressed while the contacts are open.

3. The circuit breaker of claim 2, wherein the spring is disposed to be selectively compressed while the contacts are closed.

4. The circuit breaker of claim 1 wherein the means for opening and closing the contacts comprises:

a fifth shaft supported by the support structure;

a latch link being rotatable about the fifth shaft;

a second stop latch adapted to restrict the rotation of the latch link;

a first link defining a first end and a second end, the first end being pivotally coupled to the latch link;

a second link defining a first end and a second end, the first end of second link being pivotally coupled to the second end of the first link and the second end of the second link being coupled to the first contact; and a push link defining a first end and a second end, the first end of the push link being pivotally coupled to the fourth shaft and the second end of the push link being slidably coupled to the first link;

the push link and the first link cooperating such that when the compressed spring causes the rotatable member to rotate and the second stop latch restricts rotation of the latch link, the contacts are closed such that the latch link, first link and second link hold the contacts closed.

5. The circuit breaker of claim 4, the means for opening and closing further comprising at least one opening spring adapted to bias the contacts open, wherein the contacts open when the latch link is enabled to rotate.

6. The circuit breaker of claim 5, wherein the means for rotating includes a ratchet assembly engagable with the rotatable member such that the spring is disposed to be selectively compressed while the contacts are open.

7. The circuit breaker of claim 6, wherein the spring is disposed to be selectively compressed while the contacts are closed.

8. A contact operating mechanism for a circuit breaker of the type including a support structure, a first contact and a second contact for carrying current, the contacts being adapted to be opened and closed, the operating mechanism permitting selective compression of a spring and comprising:

means for storing energy including:

a rotatable member being rotatable in a first direction about and supported by a first shaft supported by the support structure;

a second shaft supported by the rotatable member such that the second shaft is substantially parallel to the first shaft and offset from the first shaft;

a third shaft supported by the support structure such that the third shaft is substantially parallel to the first shaft and offset from the first shaft;

a fourth shaft supported by the rotatable member such that the fourth shaft is substantially parallel to the first shaft and offset from the first shaft;

a latch member rotatable about the third shaft, the latch member defining a first surface for resting upon the second shaft, the first surface defining a latch opening for engaging the second shaft;

the spring being coupled to the mounting means and the second shaft, disposed such that the spring is compressed to store energy when the rotatable member is rotated in the first direction; and the second shaft is engaged by the latch opening in response to the spring being compressed a predetermined distance;

a first stop latch which restricts the latch members from rotating such that the latch opening maintains engagement with the second shaft;

means for rotating the rotatable member in the first direction; and means, coupled to the fourth shaft, for opening and closing the contacts, the means utilizing the energy stored in the spring to close the contacts.

9. The contact operating mechanism of claim 8 wherein the means for opening and closing the contacts comprises:

a fifth shaft supported by the support structure;

a latch link being rotatable about the fifth shaft;

a second stop latch adapted to restrict the rotation of the latch link;

a first link defining a first end, the first end being pivotally coupled to the latch link;

a second link defining a first end and a second end, the first end of the second link being pivotally coupled to the second end of the first link and the second end of the second link being coupled to the first contact; and a push link defining a first end and a second end, the first end of the push link being pivotally coupled to the fourth shaft and the second end of the push link being slidably coupled to the first link;

the push link and the first link cooperating such that when the compressed spring urges the rotatable member to rotate and the second stop latch restricts rotation of the latch link, the contacts are closed, the latch link, first link and second link being disposed to hold the contacts closed.

10. The contact operating mechanism of claim 9, the means for opening and closing further comprising at least one opening spring adapted to bias the contacts open, wherein the contacts open when the latch link is enabled to rotate.

11. The contact operating mechanism of claim 10, wherein the means for rotating includes a ratchet assembly engagable with the rotatable member such that the spring is disposed to be selectively compressed while the contacts are open.

12. The contact operating mechanism of claim 11, wherein the spring is disposed to be selectively compressed while the contacts are closed.

* * * * *